United States Patent [19]

Lüke

[11] 4,189,242

[45] Feb. 19, 1980

[54] MIXER WITH A MIXING MECHANISM REVOLVING IN A CYLINDRICAL OR PARTLY CYLINDRICAL MIXING CONTAINER

[75] Inventor: Karlheinz Lüke, Egolzwil, Fed. Rep. of Germany

[73] Assignee: Gebruder Lodige Maschinenbau GmbH, Paderborn, Fed. Rep. of Germany

[21] Appl. No.: 973,728

[22] Filed: Dec. 27, 1978

[30] Foreign Application Priority Data

Jan. 5, 1978 [DE] Fed. Rep. of Germany ..... 2800371

[51] Int. Cl.[2] ..... B01F 7/04; B01F 9/22

[52] U.S. Cl. ..... 366/288

[58] Field of Search ..... 366/64, 66, 67, 287, 366/288, 279, 244, 261, 281, 282

[56] References Cited

U.S. PATENT DOCUMENTS

| | | | |
|---|---|---|---|
| 280,025 | 6/1883 | Fiederlein | 366/288 |
| 2,185,155 | 12/1939 | Meeker | 366/288 |
| 3,407,046 | 10/1968 | Massoubre | 366/287 |
| 3,785,621 | 1/1974 | Hoskins | 366/288 |
| 4,079,917 | 3/1978 | Popeil | 366/288 |

*Primary Examiner*—Robert W. Jenkins

*Attorney, Agent, or Firm*—Thomas J. Greer, Jr.

[57] ABSTRACT

A mixer has a cylindrical or partly cylindrical mixing container and a driven mixing mechanism revolving about its longitudinal axis which preferably extends horizontally. The central shaft of the mixing mechanism supports mixing tools on radial arms, ending at a short distance from the cylindrical internal wall of the mixing container. The central shaft is rotatably mounted to revolve over an arc of a circle running concentrically round the longitudinal axis of the mixing container.

5 Claims, 2 Drawing Figures

MIXER WITH A MIXING MECHANISM REVOLVING IN A CYLINDRICAL OR PARTLY CYLINDRICAL MIXING CONTAINER

FIELD OF THE INVENTION

The invention relates to a mixer with a cylindrical or partially cylindrical mixing container and a driven mixing mechanism revolving about its longitudinal axis, which preferably extends horizontally, the central shaft of the mixing mechanism supporting mixing tools on radial arms which end at a short distance from the cylindrical internal wall of the mixing container.

BACKGROUND OF THE INVENTION

In known mixers of this type, particularly in so-called ploughshare mixers, that is to say in mixers whose mixing mechanism has plough-share-like mixing tools, there is a risk of a deposit of the material being mixed building up on the internal wall of the mixing container. If this material contains interreacting components, the formation of such a deposit is particularly undesirable since the deposit can harden to such an extent that it can only be removed with a considerable amount of time-consuming effort. The hardened deposit causes abnormally high wear of the tools and, in extreme cases, can even cause the mixing mechanism to jam or prevent the mixing mechanism from starting again after a stoppage if the friction between the outer edge of the mixing tools and the deposit on the wall exceeds the start-up power of the drive mechanism which operates the mixing mechanism.

The formation of a deposit on the internal wall of the mixing container is also undesirable because portions of such deposit break off during the mixing process and fall into the material being mixed and this leads to inhomogeneities in the material. If the mixing container is provided with wall heating means, deposits of the material being mixed on the wall prevent the transfer of heat from the wall heating means into the interior of the mixing container, and the thicker the layer deposited the greater the extent to which it occurs.

Deposits of the material being mixed are able to form on the internal wall of the mixing container because the mixing tools have to revolve at a certain distance from the internal wall of the mixing container in order to ensure that there is no contact between the mixing tools and the container wall during operation.

Although the formation of a deposit can be substantially suppressed by special shaping of the mixing tools and in particular of their edges revolving in the vicinity of the container walls, the formation of a deposit cannot be avoided completely when some materials are mixed. In the past, the formation of such deposits could only be dealt with effectively by cleaning the mixing container frequently by a process involving manually detaching any deposits adhering on its internal wall and removing them from the mixing container. However, this necessitates long stoppages and high labour costs which substantially increased the operating costs of the mixer, and was therefore undesirable. In particular, a cleaning process of this type often does not meet current regulations governing operational safety and the measures protecting personnel.

BRIEF SUMMARY OF THE INVENTION

The object of the invention is to be able to reduce or break up and detach any deposits of material being mixed which are formed on the internal wall of a mixing container in a simple manner using the mixing mechanism, before the deposits harden and are able to wear out or even completely trap the revolving mixing tools.

According to the invention there is provided a mixer comprising an at least partly cylindrical mixing container having a longitudinal axis; a driven mixing mechanism revolving about the said longitudinal axis, the mixing mechanism having a central shaft which supports mixing tools on radial arms, ending at a short distance from the internal wall of the mixing container; and means for rotatably mounting the said central shaft to revolve over an arc of a circle running concentrically round the said longitudinal axis of the mixing container.

In the invention, therefore, the shaft of the mixing mechanism is not only rotatingly driven about the longitudinal axis thereof but is also moved over an arc of the circle so that the mixing tool revolves eccentrically with respect to the mixing container, the position of the greatest proximity between the revolving mixing tools and the internal wall of the mixing container changing continuously. Consequently, no deposit of uniform thickness is able to form on the internal wall of the mixing container. Instead, the mixing tools continuously work themselves into any thicker deposits present and break them up, reduce or detach them from the wall before they can harden.

The reaction of the components in a material to be mixed which tends to form a deposit lasts a certain time after contact of the components, and the reaction product then hardens. This period can be several minutes, but is often several hours. It is therefore necessary for the position of the shortest distance between the revolving mixing tools and the internal wall of the mixing container to pass over the periphery of the mixing container at least once during the reaction time of the material being mixed. Preferably, however, the shaft revolves at a considerably lower rate of revolution than its rotational speed on the arc of a circle, and this also has the advantage that the rate of progression of the position of the shortest distance between the mixing tools and the internal wall of the mixing containers is relatively low so that any deposits forming can be detached from the wall in relatively small pieces and can thus generally be mixed again homogeneously with the material being mixed.

As the distance between the revolving mixing tools and the internal wall of the mixing container is different everywhere and the position of the shortest distance shifts continuously, a deposit will form more easily in the regions of the increasing distance but these formations of deposit will invariably be scraped off almost as soon as they form because the position of the shortest distance will be continuously shifted. Although the mixing tools always revolve at certain distance from the internal wall of the mixing container over the entire periphery of the mixing container, this also being the case in known mixers, the formation of deposit can be prevented considerably better than in known mixers because a uniformly thick ring of deposit cannot form between the revolving mixing tools and the internal wall of the container. Owing to the constantly changing distance between the revolving mixing tools and the internal wall of the mixing container, deposits can also be detached and broken up in such a way that even deposits forming in the region of the minimum distance can be detached and fed back into the mixing process without direct contact between the mixing tools and the container walls having to be made. The eccentrically revolving mixing tools continuously penetrate any ring of deposit and break it up before it can solidify and harden.

The shifting of the position of this shortest distance should be small in comparison with the rotational speed of the shaft, but sufficiently large to pass over the entire periphery of the mixing container at least once within the reaction time of the products being mixed.

The radius of the arc of a circle over which the shaft revolves, and thus the eccentricity of this revolving movement, is preferably larger than the maximum bending of the shaft in the central region and is not more than about 50 mm. The eccentricity need only be a few millimeters, and is preferably at least 20% of the average distance between the mixing tools and the internal wall of the mixing container. This is achieved, for example, by mounting the shaft of the mixing mechanism in bushes with an eccentric passage, these bushes, in turn, being held synchronously or commonly rotatable in the end walls of the container and being provided with a drive mechanism. The drive problems of the eccentrically revolving shaft can be readily solved with an arrangement of this type because the connection between this shaft and the fixed drive motor or drive transmission can be produced, for example, by means of a simple cardan drive.

DETAILED DESCRIPTION OF PREFERRED EMBODIMENT

Figure 1:
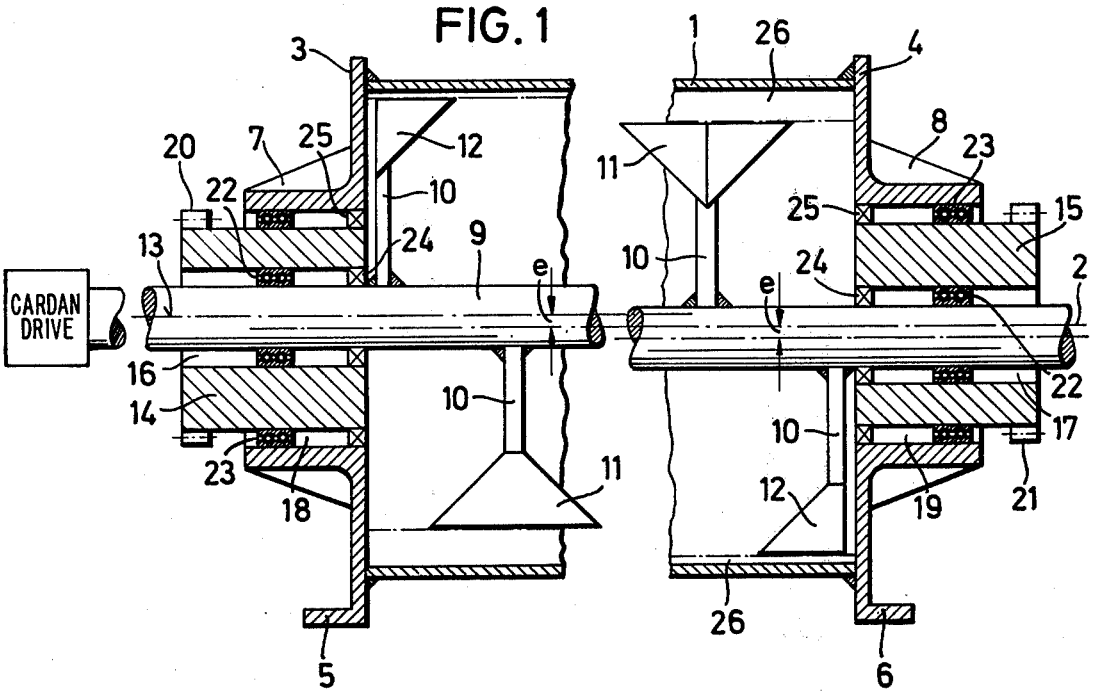
FIG. 1 shows a diagrammatic longitudinal section through the two ends of an embodiment of a mixer according to the invention.

The mixer has a closed cylindrical mixing container 1 with a horizontally extending longitudinal axis 2, which is fixed between the two end plates 3 and 4 having squared-off flanges 5 and 6 respectively at the lower end and thus acting as stands. The exterior of the end plates 3 and 4 are provided with pedestals 7 and 8 respectively which are each integral with the respective end plate in the embodiment shown.

Inside the mixing container 1 is arranged a mixing mechanism which comprises a horizontally arranged shaft 9 with radially extending arms 10 fixed thereon. Each arm bears a ploughshare-like mixing tool 11 or a partly ploughshare-like mixing tool 12 at the external end. The longitudinal axis 13 of the shaft 9 lies parallel to the longitudinal axis 2 of the mixing container 1, but is offset from it by a distance e and revolves with this eccentricity e over an arc of a circle having a radius e.

This is achieved by mounting the shaft 9 in the region of each end plate 3 and 4 in bushes 14 and 15 respectively, each of which has an eccentric passage 16 and 17 respectively with an eccentricity e. The bushes 14 and 15 are, in turn, rotatably mounted in central passages 18 and 19 of the pedestal 7 and 8 respectively and can be rotated in a manner not described in detail by means of a molded toothed ring 20 or 21 about their longitudinal axis which coincides with the longitudinal axis 2 of the mixing container 1. As may be seen from FIG. 1, the bushes 14 and 15 are mounted so as to rotate independently of the rotation of central shaft 9.

The mounting between the shaft 9 and the bushes 14 and 15 on the one hand and between the bushes 14 and 15 and the pedestals 7 and 8 on the other hand is accomplished in the embodiment shown by means of ballbearings 22 and 23, and sealing rings 24 and 25 are also provided.

Figure 2:
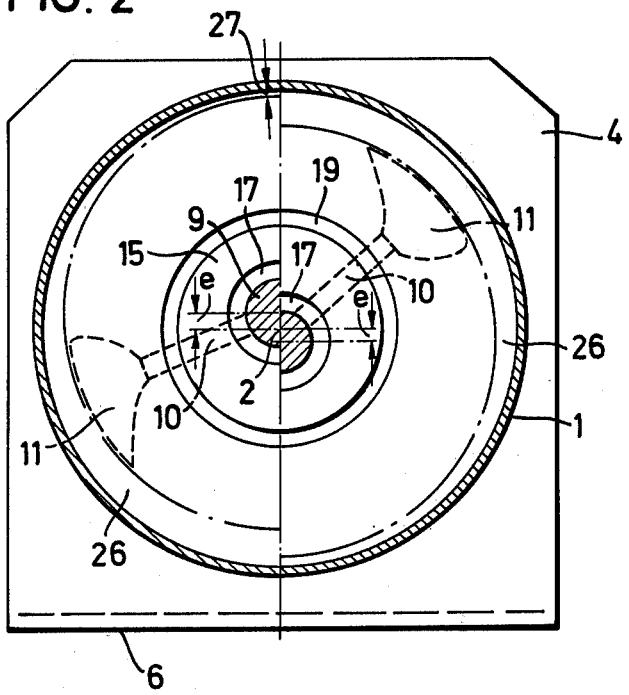
FIG. 2 shows a cross-section through the mixer of FIG. 1.

Owing to the eccentric mounting of the shaft 9, the region 26 not covered by the mixing tools between the internal wall of the cylindrical mixing container 1 and the mixing tools 11 is not uniformly thick but of thickness when viewed over the periphery of the mixing container, as shown, in particular, in FIG. 2. However, since the shaft 9 is not only mounted eccentrically relative to the longitudinal axis 2 of the mixing container 1 but also revolves continuously with an eccentricity e over an arc of a circle which is concentric with the longitudinal axis 2, the position 27 of the shortest distance between the revolving mixing tools 11 and 12 and the internal wall of the mixing container 1 travels along the internal wall of the mixing container 1 so that a deposit of uniform thickness cannot form anywhere on the periphery of the mixing container 1. Instead, the thickness of the space allowing a deposit to form varies continuously from a minimum to a maximum, depending upon the revolution of the shaft 9 over the arc of a circle running round the longitudinal axis 2 of the mixing container 1, so that deposits are always reduced again, detached and broken up as they occur. As the deposits cannot harden or solidify in any other way, it does not adversely affect the mixing if the deposits fall back into the material being mixed because they can immediately be homogeneously mixed with the mass of the material.

I claim:

1. A mixer comprising an at least partly cylindrical mixing container having a longitudinal axis; a driven mixing mechanism revolving about the said longitudinal axis, the mixing mechanism having a central shaft which supports mixing tools on radial arms ending at a short distance from the internal wall of the mixing container; and means for rotatably mounting the said central shaft to revolve over an arc of a circle running concentrically round the said longitudinal axis of the mixing container, said means permitting the rate of rotation of the said central shaft about its own axis to be independent of the rate of rotation about said arc of a circle.

2. A mixer according to claim 1, wherein the said circle has a radius which is larger than the maximum bending of the shaft and is not more than about 50 mm.

3. A mixer according to claim 2, wherein the said radius is at least 20% of the average distance between the mixing tools and the internal wall of the mixing container.

4. The mixer according to claim 1, said means is defined by the shaft being mounted in a pair of spaced apart bushes, each having an eccentric passage therein in which carries the shaft, the bushes being centrally mounted in end walls of the said cylindrical container, the bushes carrying means enabling them to be driven synchronously with each other.

5. A mixer according to claim 1, wherein the said axis extends horizontally.

* * * * *